US007680283B2

(12) United States Patent
Eskildsen

(10) Patent No.: US 7,680,283 B2
(45) Date of Patent: Mar. 16, 2010

(54) METHOD AND SYSTEM FOR DETECTING A PREDETERMINED SOUND EVENT SUCH AS THE SOUND OF BREAKING GLASS

(75) Inventor: Kenneth G. Eskildsen, Great Neck, NY (US)

(73) Assignee: Honeywell International Inc., Morristown, NJ (US)

( * ) Notice: Subject to any disclaimer, the term of this patent is extended or adjusted under 35 U.S.C. 154(b) by 1180 days.

(21) Appl. No.: 11/052,674

(22) Filed: Feb. 7, 2005

(65) Prior Publication Data

US 2006/0177071 A1 Aug. 10, 2006

(51) Int. Cl.
*H04R 29/00* (2006.01)
*G08B 13/00* (2006.01)

(52) U.S. Cl. ..... 381/56; 340/550; 340/541; 340/566

(58) Field of Classification Search ..... 381/56, 381/57; 340/541, 545, 550, 565, 566, 545.1–545.9, 340/553
See application file for complete search history.

(56) References Cited

U.S. PATENT DOCUMENTS 3,074,053 A 1/1963 McDonough et al.
3,242,486 A 3/1966 Corbell
3,573,817 A 4/1971 Akers
3,634,846 A 1/1972 Fogiel
3,725,888 A 4/1973 Solomon
3,801,978 A 4/1974 Gershberg et al.
3,889,250 A 6/1975 Solomon
3,946,377 A 3/1976 Zetting
3,967,283 A 6/1976 Clark et al.
3,979,740 A 9/1976 Forbat et al.
4,054,867 A 10/1977 Owens
4,088,989 A 5/1978 Solomon
4,091,660 A 5/1978 Yanagi
4,112,420 A 9/1978 Mifune et al.
4,117,464 A 9/1978 Lutz
4,134,109 A 1/1979 McCormick et al.
4,142,188 A 2/1979 Zetting et al.
4,180,811 A 12/1979 Yoshimura et al.
4,222,041 A 9/1980 Von Tomkewitsch et al.
4,225,859 A 9/1980 Zetting et al.
4,307,387 A 12/1981 Baxendale
4,342,987 A 8/1982 Rossin
4,364,030 A 12/1982 Rossin
4,377,808 A 3/1983 Kao
4,401,976 A 8/1983 Stadelmayr
4,410,884 A 10/1983 Heiland
4,437,089 A 3/1984 Achard
4,468,657 A 8/1984 Rossin (Continued)

*Primary Examiner*—Xu Mei
(74) *Attorney, Agent, or Firm*—Husch Blackwell Sanders Welsh & Katz

(57) ABSTRACT

A method and system for detecting a predetermined sound event, such as the sound of breaking glass. Data representing monitored sounds is stored, such as in a circular buffer, while a preliminary assessment is made in real time as to whether the monitored sounds potentially include the predetermined sound event. If there is a potential correspondence, the already stored, pre-event data is frozen, and additional data including, and following, the event is stored. Next, the stored pre-event and additional data is retrieved from storage and provided to a processor that applies one or more algorithms to determine, with finality, if the event corresponds to the pre-determined sound event.

12 Claims, 2 Drawing Sheets

U.S. PATENT DOCUMENTS

| | | | | |
|---|---|---|---|---|
| 4,468,658 | A | | 8/1984 | Rossin |
| 4,482,889 | A | | 11/1984 | Tsuda et al. |
| 4,611,197 | A | | 9/1986 | Sansky |
| 4,625,199 | A | | 11/1986 | Pantus |
| 4,660,024 | A | | 4/1987 | McMaster |
| 4,668,941 | A | | 5/1987 | Davenport et al. |
| 4,710,750 | A | | 12/1987 | Johnson |
| 4,772,875 | A | | 9/1988 | Maddox et al. |
| 4,837,558 | A | | 6/1989 | Abel et al. |
| 4,845,464 | A | | 7/1989 | Drori et al. |
| 4,853,677 | A | | 8/1989 | Yarbrough et al. |
| 4,882,567 | A | | 11/1989 | Johnson |
| 4,928,085 | A | | 5/1990 | DuRand, III et al. |
| 4,970,517 | A | | 11/1990 | Williams |
| 4,991,145 | A | | 2/1991 | Goldstein et al. |
| 5,023,593 | A | | 6/1991 | Brox |
| 5,057,817 | A | | 10/1991 | Berube |
| 5,077,548 | A | | 12/1991 | Dipoala |
| 5,107,249 | A | | 4/1992 | Johnson |
| 5,117,220 | A | | 5/1992 | Marino et al. |
| 5,164,703 | A | | 11/1992 | Rickman |
| 5,185,593 | A | | 2/1993 | DuRand, III et al. |
| 5,192,931 | A | | 3/1993 | Smith et al. |
| 5,276,427 | A | | 1/1994 | Peterson |
| 5,323,141 | A | | 6/1994 | Petek |
| RE34,788 | E | | 11/1994 | DuRand, III et al. |
| 5,376,919 | A | | 12/1994 | Rickman |
| 5,438,317 | A | | 8/1995 | McMaster |
| 5,450,061 | A | | 9/1995 | McMaster |
| 5,471,195 | A | | 11/1995 | Rickman |
| 5,475,365 | A | | 12/1995 | Hoseit et al. |
| 5,510,767 | A | | 4/1996 | Smith |
| 5,543,783 | A | * | 8/1996 | Clark et al. ..... 340/550 |
| 5,552,770 | A | | 9/1996 | McMaster |
| 5,675,320 | A | | 10/1997 | Cecic et al. |
| 5,742,232 | A | * | 4/1998 | Kurahashi et al. ..... 340/550 |
| 5,796,336 | A | | 8/1998 | Ishino et al. |
| 5,831,528 | A | * | 11/1998 | Cecic et al. ..... 340/550 |
| 5,917,775 | A | | 6/1999 | Salisbury |
| 6,064,303 | A | * | 5/2000 | Klein et al. ..... 340/506 |
| 6,107,918 | A | * | 8/2000 | Klein et al. ..... 340/511 |
| 6,130,602 | A | | 10/2000 | O'Toole et al. |
| 6,236,313 | B1 | | 5/2001 | Eskildsen et al. |
| 6,272,411 | B1 | | 8/2001 | Corrado et al. |
| 6,351,214 | B2 | | 2/2002 | Eskildesen et al. |
| 6,538,570 | B1 | | 3/2003 | Smith |
| 7,319,392 | B2 | * | 1/2008 | Babich et al. ..... 340/545.2 |

* cited by examiner

METHOD AND SYSTEM FOR DETECTING A PREDETERMINED SOUND EVENT SUCH AS THE SOUND OF BREAKING GLASS

BACKGROUND OF THE INVENTION

1. Field of Invention

The invention relates generally to a method and system for detecting a predetermined sound event such as the sound of breaking glass.

2. Description of Related Art

Sound processors are used to detect predetermined sounds. For example, glass breakage sensors are designed to detect the breakage of framed glass within the perimeter of a protected space. One or more of such sensors may be arranged in the protected space along with other sensors such as motion detectors, and window or door switches that detect the opening of a window or door, respectively. When any of the sensors detects an intrusion, the sensor transmits a signal to a control panel that then sounds an alarm. Glass breakage sensors commonly include a microphone and an audio processor to monitor the sounds within the protected space to determine if the glass has been broken. Typically, this is achieved by determining if the level of the monitored sound exceeds a threshold. A problem with this arrangement is that sounds other than that of breaking glass, such as a dog barking, a balloon pop, or the closing of a kitchen cabinet, can fool existing audio processors and cause false alarms. As such, it is desirable to build a device that will detect the breaking of a window, or other predetermined sound events, while reducing or eliminating false alarms cause by similar sounds.

BRIEF SUMMARY OF THE INVENTION

The present invention addresses the above and other issues by providing a method and system for detecting a predetermined sound event. In one possible implementation, the method and system is used for detecting the sound of breaking glass, where data representing monitored sounds in a protected spaced is stored while a preliminary assessment is made in real time as to whether the monitored sounds may include a glass breakage event. If the preliminary assessment indicates there is a glass breakage event, additional data is stored. Next, the stored data representing the monitored sounds before, during and after the event is retrieved from storage and provided to a processor, which applies any number of more detailed algorithms to determine, with finality, if the event should be declared an actual glass break event.

The invention may be adapted for use in detecting other sound events, e.g., thunder, lightning, voices, gun shots, and the like.

In particular, in one aspect of the invention, a sound processor for detecting a predetermined sound event includes a microphone for monitoring sounds, a storage resource for storing first data representing the monitored sounds over a first time period, first circuitry for determining if the monitored sounds potentially include the predetermined sound event, and second circuitry responsive to the first circuitry for storing second data representing the monitored sounds over a second time period that follows the first time period when the first circuitry determines that the monitored sounds potentially include the predetermined sound event.

In a further aspect of the invention, a sound processor for detecting a predetermined sound event includes means (110) for monitoring sounds, means (136) for storing first data representing the monitored sounds over a first time period, first means (130) for determining if the monitored sounds potentially include the predetermined sound event, and second means (137) responsive to the first means for storing second data representing the monitored sounds over a second time period that follows the first time period when the first means determines that the monitored sounds potentially include the predetermined sound event.

In a further aspect of the invention, a method for detecting a predetermined sound event includes monitoring sounds (110), storing first data (136) representing the monitored sounds over a first time period, determining (130) if the monitored sounds potentially include the predetermined sound event, and storing second data (137) representing the monitored sounds over a second time period that follows the first time period when the determining step determines that the monitored sounds potentially include the predetermined sound event.

BRIEF DESCRIPTION OF THE DRAWINGS

In the drawings.

In all the Figures, corresponding parts are referenced by the same reference numerals.

DETAILED DESCRIPTION OF THE INVENTION

Generally, the invention improves the reliability of sound processors used for detecting predetermined sounds. In an example implementation, the invention improves the acoustic glass breakage detector false alarm problem by using an improved sensor architecture that allows for the use of a more sophisticated, reliable detection algorithm. Furthermore, the invention allows for the use of multiple audio processor algorithms to detect the breakage of framed glass, thereby increasing the reliability of the detection even further. The improved architecture allows for processing of pre-detection and post-detection audio to distinguish between actual and nuisance alarms. The architecture is suitable for hardwired, Honeywell V-plex™ polling loop technology, and wireless applications, for instance. Moreover, the invention can be implemented using a conventional microprocessor as well as a digital signal processor (DSP). In addition, the detector is software upgradeable without the need for hardware changes to accommodate new detection algorithms that may be developed.

Figure 1:
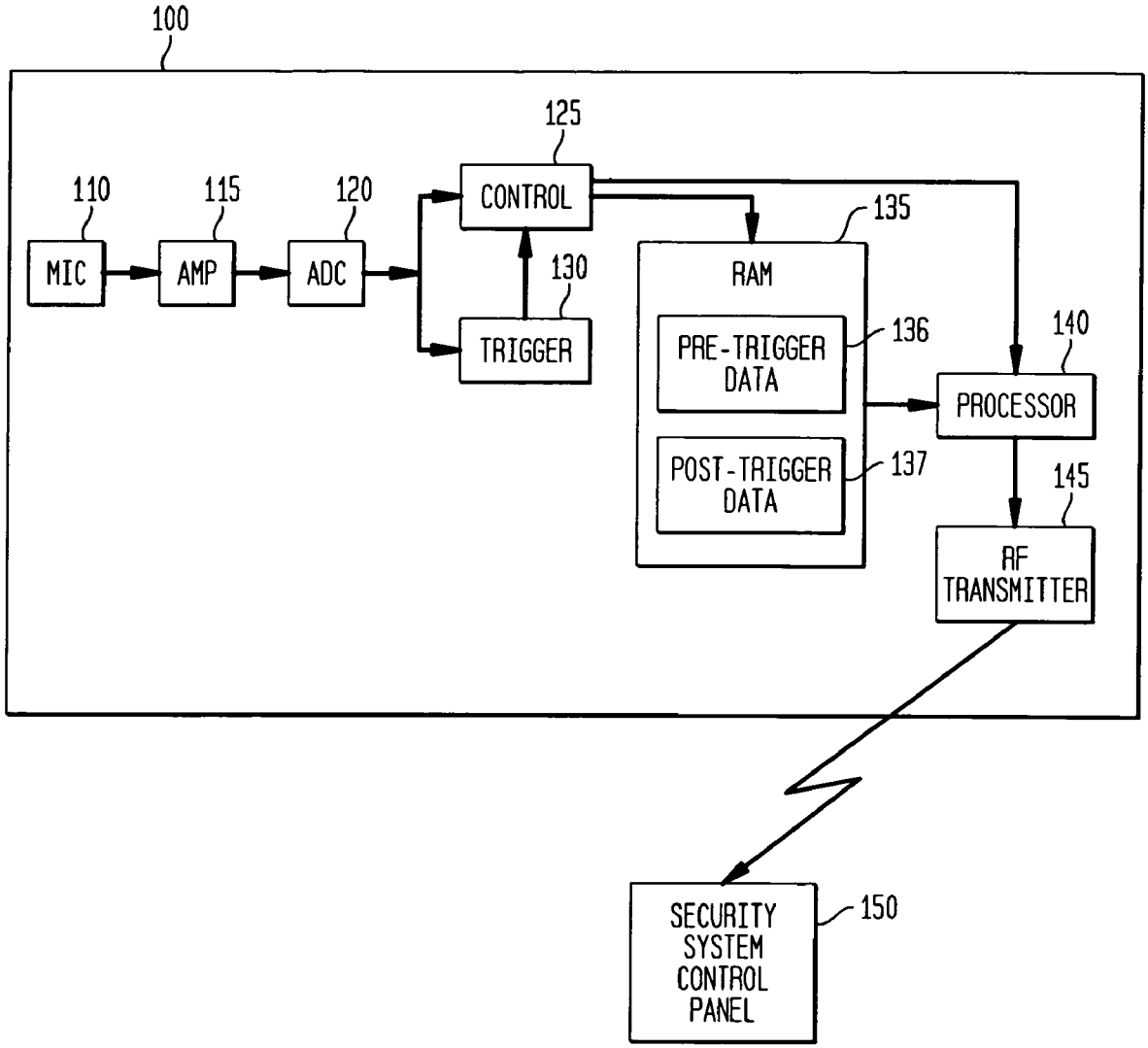
FIG. 1 illustrates a block diagram of a sound processor apparatus, according to the invention.

FIG. 1 illustrates a block diagram of a sound processor, according to the invention. The apparatus, shown generally at 100, includes a microphone (MIC) for monitoring sounds. In a security system application, the sounds may be monitored in a protected space, such as a room. The microphone 110 outputs an analog audio signal that is amplified by an amplifier (AMP) 115. The output from the amplifier 115 is digitized at an analog-to-digital converter (ADC) 120 to provide digitized audio samples to a control circuitry 125 and a trigger circuitry 130.

The control circuitry 125 stores the digitized audio samples in a subset area 136 of a storage resource such as a random access memory (RAM) 135 dedicated to pre-event (pre-trigger) audio samples. The control circuitry 125 ensures that the ADC samples remain within the bounds of the pre-trigger RAM and keeps track of the oldest and newest samples. The samples may be stored in a first-in, last-out manner so that the subset storage area 136 provides a circular buffer in which samples that represent the monitored sounds for a first predetermined time period preceding an event that potentially corresponds to a predetermined sound event are stored. As each new sample is stored, the oldest sample is overwritten. The digitizing and storage of samples in the subset storage area 136 continues during pre-event operation, prior to when the event is detected. In particular, the trigger circuitry 130 determines if the monitored sounds potentially include a predetermined sound event. For example, this may be achieved by determining, substantially in real-time, whether the audio samples exceed a predetermined threshold. When the audio samples exceed the predetermined threshold, the trigger circuitry 130 signals the control circuitry 125 to store subsequent samples in a second subset storage area 137, termed a post-trigger area, of the memory 135. In particular, samples that represent the monitored sounds over a second time period that follows the first time period are stored in the subset storage area 137. For example, samples that represent the monitored sounds during, and following, the potential glass break event over the second time period may be stored in the subset storage area 137. Once the pre-trigger and post-trigger RAM subset areas 136 and 137, respectively, have been filled, there is essentially a recording of the audio data before, during and after the potential trigger event. At this point, the control circuitry 125 signals the processor 140 to retrieve the pre-event and post-event samples from the subset storage areas 136 and 137, and to process the samples, which represent a recorded audio signal. Note that the use of separate designated storage areas in the RAM 135 for pre-event and post-event data is one possible implementation, as other arrangements are possible. The post-event or post-trigger data may include the data from during the potential trigger event as well.

The processor 140 can perform one or a multitude of algorithms on the recorded signal without concern that information will be lost due to processing latency. In addition, the algorithms can process the audio that occurred before and/or after the trigger event to help determine, with finality, whether the monitored sounds include the predetermined sound event. For example, the processor 140 may determine whether a potential glass break event should be declared an actual glass break event. This approach is compatible with existing algorithms, such as those used in the Honeywell FlexGuard® FG series of detectors, for instance. Examples of known glass break detection algorithms are described in U.S. Pat. No. 6,236,313 to Eskildsen et al., issued May 22, 2001, and entitled "Glass Breakage Detector", U.S. Pat. No. 6,351,214 to Eskildsen et al., issued Feb. 26, 2002, and entitled "Glass Breakage Detector", and U.S. Pat. No. 6,538,570 to Smith, issued Mar. 25, 2003, and entitled "Glass-Break Detector and Method of Alarm Discrimination", each of which is incorporated herein by reference.

The approach described herein provides advantages over other systems that only process audio data in real time. This limits such systems to algorithms that can be performed between audio samples, where a predetermined change between samples triggers an event, or by comparing audio samples to a predetermined threshold, where an event is triggered if a sample exceeds the predetermined threshold. These approaches also limit the bandwidth of the signals that could be processed because higher bandwidth signals shorten the time between audio samples and thereby shorten the amount of processing that can be performed between samples because the processing occurred in real-time. In contrast, with the present invention, more detailed and reliable algorithms can be used. When multiple algorithms are used, the results from each can be factored in deciding whether there is an actual glass break event. Moreover, a priority or weight may be assigned to the algorithms so that those that are known to be more reliable are given more weight in deciding whether the monitored sounds include the predetermined sound event. Furthermore, a statistical approach may be used where one or more algorithms provide a probability that the monitored sounds include the predetermined sound event, and a final determination is made by accounting for the probabilities from each algorithm. The invention can employ only one algorithm as well.

If the processor 140 determines that the monitored sounds include the predetermined sound event, such as a glass break event, it may activate a transmitter 145, such as a wireless RF transmitter, to transmit an alarm signal to a security system control panel 150. It may also send the alarm signal to the control panel via a wired connection.

Figure 2:
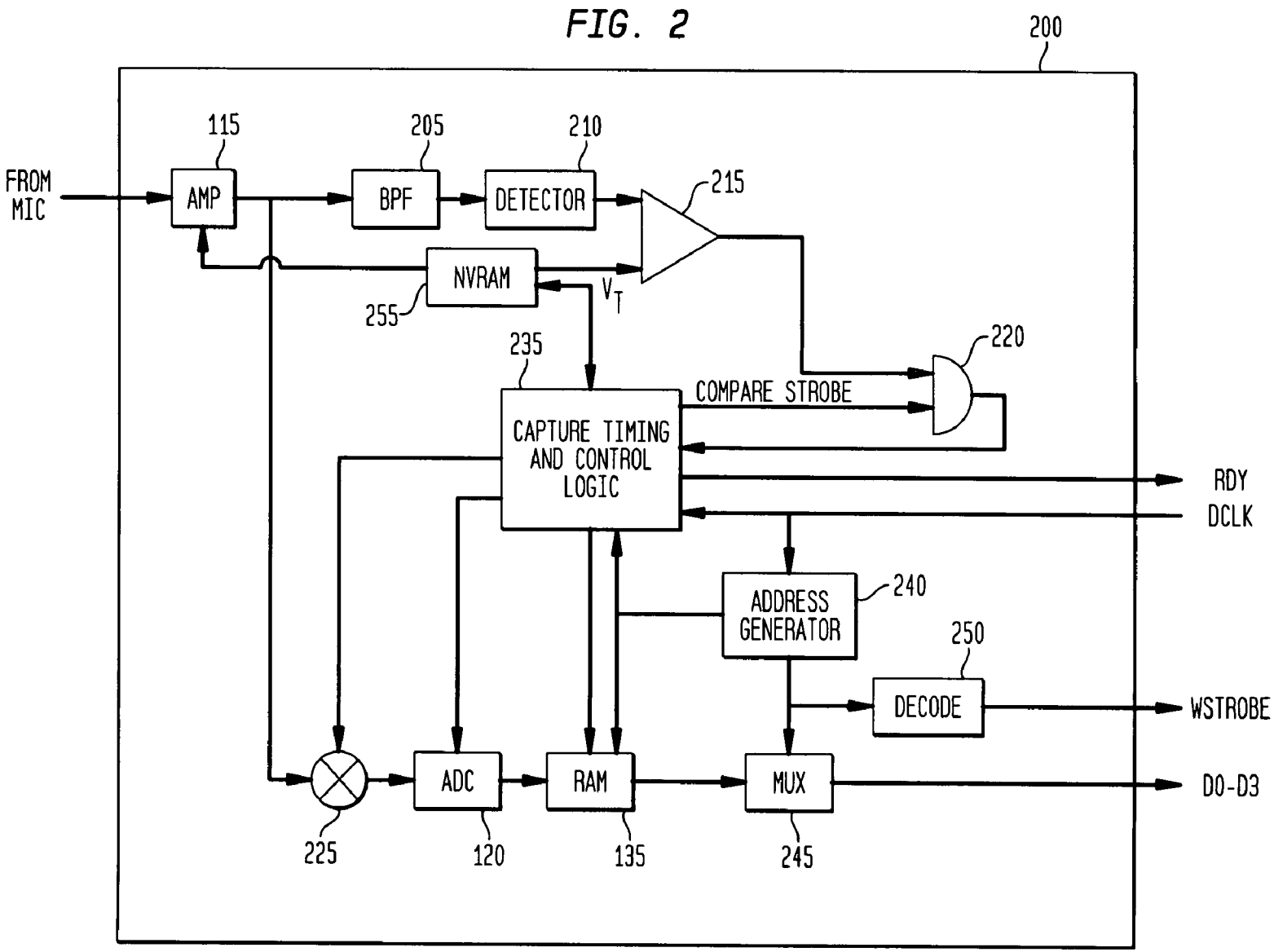
FIG. 2 illustrates a block diagram of an application-specific integrated circuit (ASIC) for use in a sound processor, according to the invention.

FIG. 2 illustrates a block diagram of an application-specific integrated circuit (ASIC) for use in a sound processor, according to the invention. In one possible approach, the AMP 115, ADC 120, control circuitry 125, trigger circuitry 130 and RAM 135 of FIG. 1 are provided in an ASIC 200. The ASIC described herein is a custom integrated circuit used for the signal conditioning of a microphone-generated signal and for buffering that signal for application to an external microcontroller or DSP integrated circuit, such as the processor 140.

At the center of the ASIC 200 is a capture timing and control function 235, e.g., a control, which receives a voltage controlled oscillator (VCO) clock signal and generates a series of sequential pulses that are used to sample data, at a sample and hold (S/H) circuit 225, convert data at an ADC 120, provide a compare strobe to an AND gate 220, and store data in the memory 135. These pulses all occur at the same repetition rate and are time shifted from one another, based on S/H, A/D, CODEC and memory timing requirements. Also, an internal countdown clock generates a clock signal suitable for running a microcontroller, such as the processor 140. The mode as to Read or Write is determined by a R/W-PROG input. The capture timing and control function 235 provides a RDY (ready) signal to the processor 140 to inform the processor that data is ready to be output from the memory 135 for analysis to determine whether an actual glass break event has occurred. The processor responds to the RDY signal by providing a data clock signal DCLK, which causes the data in the memory 135 to be output to the processor.

In further detail, the microphone's signal is pre-amplified, passed through an equalization filter, and low pass filtered at the AMP 115. The equalizer corrects for the diminished high-end frequency response from the microphone. The low pass filter, which can be part of the equalizer, is used to band limit the input signal so as to prevent aliasing when digitizing the analog signal. The functions of the AMP 115 may be combined as a single, signal conditioning circuitry block.

The output of the AMP 115 is sent through a bandpass filter (BPF) 205 and then a detection circuit 210, which converts the AC audio signal into a slowly varying DC level. The detection circuit 210 defines the slowly varying DC level by tracking band-pass average voltage and band-pass average peak voltage of the output of the BPF 205. The value of this detected signal is compared to a reference threshold voltage ($V_T$), at a comparator 215, and, if it exceeds the threshold, it is fed as a logic level to a strobed AND gate 220. That is, as mentioned, the capture timing and control logic function 235 provides a compare strobe to the AND gate 220. If the detected signal is large enough, the capture timing and control logic function 235 is responsive to the strobed output of the AND gate 220 for starting a preset timer to fill up a memory bank in the RAM 135 with post-event data.

The output of the AMP 115 is also sent to the sample and hold circuit 225 and the ADC 120, which periodically sample the audio signal and convert it into a twelve bit digital representation. The data is continuously stored in a 1K×12 circular buffer in the RAM 135 and, after 1,024 samples, the data is over-written. As mentioned, this buffer acts as a pre-event storage. In one possible configuration, the RAM 135 may be an 8K×12-bit memory array partitioned as a dual bank memory. When a potential glass break event is detected, based on the output of the AND gate 220, the capture timing and control logic function 235 freezes the circular buffer in the RAM 135 and directs an additional 7K×12 memory bank in the RAM 135 to be filled up with post-event data as it is received. The allocation of the RAM 135 between pre-event and post-event data can be set as desired or as needed by the detection algorithms used. Once the additional 7K of data is stored, all data in the memory is frozen and retained until it is externally clocked out to the processor 140 on the four output data lines D0-D3, responsive to the DCLK signal. When the memory 135 is fully loaded, the RDY (ready) level flag signal is raised by the capture timing and control logic function 235, indicating to an external controller, such as the processor 140, that the data is ready to be retrieved and processed. In particular, The RDY line is used to annunciate when a potential glass break event has occurred and, in addition, when a complete data record has been fully stored in the internal memory 135. A single sampling clock period pulse on the RDY line provides the annunciation. A data record fully stored indication is that the RDY line goes to a HI. It is restored to logic LO upon the first negative-going edge of the DCLK signal.

Internal address counting circuitry in the function 235 arranges the data from the 1K circular buffer and the 7K memory to appear as sequential, contiguous, stored, sampled data. In particular, the capture timing and control logic function 235 sends clock signals to the RAM 135 that cause the stored data to be output to the processor 140 over four parallel data lines (D0 to D3) as groups of three 4-bit nibbles. A total of 8,192×3 clock pulses completely read out all of the data. The most significant bit (MSB) of the first nibble of the three-nibble data word is identified by a WSTROBE signal going high. In particular, although there are twelve-bit data words stored in the memory, there are only four data output lines, in the example implementation. The multiplexer (MUX) 245 follows the RAM 135 and selects from the 12-bit parallel output word, one of three 4-bit data nibbles. As successive DCLK pulses come in, the MUX 245 sequences through the three, 4-bit nibbles. Two address lines control the nibble selection, where only three out of four possible address combinations are used. At a decode function 250, the MSB of the nibble is decoded and is used to form the WSTROBE signal.

The DCLK input advances an address pointer provided by an address generator 240 that controls the memory 135. DCLK is also used as a clock that loads data into a non-volatile memory 255 when in a Program Mode during ASIC final test. The appearance of the DCLK signal also is used to reset the RDY signal flag. DCLK is additionally used during system test to clock data into the NVRAM Registers and into the NVRAM.

The address generator 240 is responsive to the DCLK signal for generating a pointer address for the memory 135, both for storing and retrieving data. The address generator 240 can be set up so that, after a RDY signal is generated, and all data in the memory 135 is frozen, sending in 8,192×3 clock signals on the DCLK line will result in data retrieval of the entire record. Data will be output in parallel across the four data lines. The 1,024 bytes stored in the 1K, pre-event segment of memory may be output first, with data from the furthest back first and the most recent data last, e.g., on a first-in, first-out basis. The next byte output would be from the post-event, 7K-memory bank segment, starting with the byte stored at the time slot just after when the compare strobe was generated. In one possible approach, the output of the memory 135 is a time sequence unequally bracketing the time when the compare strobe was generated, with one-eighth of the data being prior and seven-eighths of the data being after the compare strobe was generated, yielding a 12.5% pre-trigger of look-ahead data, in one possible approach.

The ASIC 200 may further contain an internal voltage regulator to provide on-chip operating voltage and any necessary reference voltages. An internal sixteen-bit nonvolatile (NVRAM) 255 inside the ASIC 200 may be used for presetting the threshold voltage ($V_T$), the attenuator value of the microphone signal in the AMP 115, and for viewing internal test points. An internal voltage controlled oscillator (VCO) is referenced to an external crystal and used for digital filter clock generation, memory clock generation and also for outputting an external clock that can be used by the processor. The detailed timing and control are performed in the capture timing and control logic function 235. The NVRAM 255 is loaded by shifting 4-bit wide parallel data words, over the four data lines, into four, 4-bit registers, and clocked in using the DCLK line.

Additionally, power saving logic may be used in the ASIC 200 to save battery power by cycling off circuitry that has no requirement for being on during certain phases of operation. An example of this is 7K post-event storage area of the 8K-memory array 135, which is only used after a potential glass break event has occurred.

While there has been shown and described what are considered to be preferred embodiments of the invention, it will, of course, be understood that various modifications and changes in form or detail could readily be made without departing from the spirit of the invention. It is therefore intended that the invention not be limited to the exact forms described and illustrated, but should be construed to cover all modifications that may fall within the scope of the appended claims.

What is claimed is:

1. A glass breakage detector comprising:

a microphone to convert incident audio signals to analog electrical signals;

an analog band pass filter with an input coupled to the analog electrical signals, a filtered output therefrom is coupled to detection circuitry which emits as an output signal a varying direct current-type signal defined by tracking band-pass average voltage and band-pass average peak voltage of an output of the analog band pass filter;

a comparator with a reference threshold coupled to a first input port of the comparator and with the output signal coupled to a second input port of the comparator wherein the comparator, responsive to the value of the outputs signal generates a trigger signal and enables storage of a plurality of samples of the analog electric signals; and circuitry, responsive to at least the stored plurality of samples to establish the presence of a glass breakage event.

2. The glass breakage detector as in claim 1 which includes pre-trigger signal data storage circuits and post-trigger data storage circuits where the pre-trigger data storage circuits are continually over-written by samples of the analog electric signals until the trigger signal is generated.

3. The glass breakage detector as in claim 2 where the microphone is coupled to an input port of a selected integrated circuit, the integrated circuit carries the filter, the comparator and includes a data ready output port, and a data clock input port.

4. The glass breakage detector as in claim 3 where the integrated circuit carries non-volatile storage which can be used to programmably establish the threshold value.

5. The glass breakage detector as in claim 3 where the data storage circuits are carried by the selected integrated circuit.

6. The glass breakage detector as in claim 5 with control circuits carried on the integrated circuit coupled at least to the data storage circuits and to the comparator.

7. The glass breakage detector as in claim 6 where the integrated circuit carries non-volatile storage which can be used to programmably establish the threshold value.

8. The glass breakage detector as in claim 6 where the control circuits are in a program mode when the threshold value is being programmed.

9. A glass breakage detector comprising:

a microphone;

an integrated circuit with an analog input port coupled to the microphone;

trigger circuits, carried by the integrated circuit and coupled to the analog input port, the trigger circuits establish a DC-type signal indicative of a glass breaking event;

control circuits and storage circuits carried by the integrated circuit with the control circuits coupled to the DC-type signal indicative of the glass breaking event where the storage circuits receive and store both pre-trigger and post-trigger data; and processing circuits, coupled to a data output port of the integrated circuit to detect the presence of a glass breakage event in response to the stored data.

10. The glass breakage detector as in claim 9 which includes in the integrated circuit programmable reference value establishing non-volatile storage circuits coupled to the trigger circuits.

11. The glass breakage detector as in claim 10 where the trigger circuits include an analog comparator with a reference input coupled to the non-volatile storage circuits and with a signal input for the DC-type signal.

12. The glass breakage detector as in claim 11 where the control circuits are in a program mode when the programmable reference value is being programmed.

* * * * *